US012565785B2

(12) United States Patent
Spriggs

(10) Patent No.: US 12,565,785 B2
(45) Date of Patent: Mar. 3, 2026

(54) WAVE POOL

(71) Applicant: Tony L. Spriggs, San Clemente, CA (US)

(72) Inventor: Tony L. Spriggs, San Clemente, CA (US)

( * ) Notice: Subject to any disclaimer, the term of this patent is extended or adjusted under 35 U.S.C. 154(b) by 197 days.

(21) Appl. No.: 18/485,859

(22) Filed: Oct. 12, 2023

(65) Prior Publication Data

US 2024/0110397 A1 Apr. 4, 2024

Related U.S. Application Data

(63) Continuation-in-part of application No. PCT/US2023/018043, filed on Apr. 10, 2023, and a continuation-in-part of application No. 17/658,891, filed on Apr. 12, 2022, now Pat. No. 11,891,835, said application No. PCT/US2023/018043 is a continuation of application No. 17/658,891, filed on Apr. 12, 2022, now Pat. No. 11,891,835.

(51) Int. Cl.
*E04H 4/00* (2006.01)
*A63B 69/00* (2006.01)

(52) U.S. Cl.
CPC ..... *E04H 4/0006* (2013.01); *A63B 69/0093* (2013.01)

(58) Field of Classification Search
CPC .. E04H 4/0006; A63B 69/0093; A63B 69/125
USPC ..... 405/79; 4/491
See application file for complete search history.

(56) References Cited

U.S. PATENT DOCUMENTS

| | | | | |
|---|---|---|---|---|
| 3,913,332 | A | 10/1975 | Forsman | |
| 4,276,664 | A | 7/1981 | Baker | |
| 4,522,535 | A | 6/1985 | Bastenhof | |
| 4,979,244 | A | 12/1990 | Bastenhof | |
| 4,999,860 | A | 3/1991 | Chutter et al. | |
| 10,407,927 | B1 | 9/2019 | Spriggs | |
| 11,471,780 | B2 | 10/2022 | McFarland | |
| 2008/0085159 | A1* | 4/2008 | McFarland | E04H 4/0006 4/491 |
| 2013/0227777 | A1 | 9/2013 | McFarland | |
| 2015/0104093 | A1 | 4/2015 | Ding et al. | |
| 2015/0204093 | A1 | 7/2015 | Smythe | |
| 2017/0138074 | A1 | 5/2017 | Lochtefeld | |
| 2017/0226762 | A1 | 8/2017 | Fricano | |
| 2017/0239580 | A1 | 8/2017 | Immonen et al. | |
| 2022/0290455 | A1 | 9/2022 | Ginestet | |

FOREIGN PATENT DOCUMENTS

| | | |
|---|---|---|
| FR | 2564534 | 11/1985 |
| FR | 2693225 | 1/1994 |
| JP | 5202626 | 8/1993 |
| JP | 8312175 | 11/1996 |

OTHER PUBLICATIONS

International Search Report and Written Opinion dated Aug. 29, 2023 from IA PCT/US2023/018043.

* cited by examiner

*Primary Examiner* — Sunil Singh
(74) *Attorney, Agent, or Firm* — Bruce A. Lev

(57) ABSTRACT

Devices and methods for generating surfable waves in a pool. Waves are generated by removing support, at a progression of areas at the bottom of the pool, for the water in the pool and causing rapid downflow at a progression of areas at the bottom of the pool.

15 Claims, 8 Drawing Sheets

Initial condition, closed and stable level

Inflow condition, vent open and rapid inflow

Stopped condition, closed and level at partially flooded level 1

Inflow condition 2, vent re-opened for second rapid inflow

WAVE POOL

This application is a continuation-in-part of U.S. application Ser. No. 17/658,891, filed Apr. 12, 2022, pending, and a continuation-in-part of PCT Application PCT/US2023/018043, filed Apr. 10, 2023, pending. The entirety of U.S. application Ser. No. 17/658,891 and PCT Application PCT/US2023/018043, are hereby incorporated by reference.

FIELD OF THE INVENTIONS

The inventions described below relate to the field of wave pools for generating waves, in particular large surfable waves.

BACKGROUND OF THE INVENTIONS

Wave generator systems are used to create desired wave forms for surfers. The process may be used to create waves for competition or merely user enjoyment. The ability to generate consistent waves is advantageous to surfers so that they do not have to wait for a particular wave according to an ocean surfing protocol. In addition, a wave generating system capable of producing consistent waves can be used for surfing competitions, because it can ensure all surfers are afforded the opportunity to ride identical waves to normalize competition.

Though wave generating systems are promising as a technique for generating uniform waves for a user, their use has been hampered by the lack of ability to provide wave generating systems that generate consistent waves, inefficiency in transferring energy to the wave, complexity of design of the pool and foils used to generate waves, and a high cost of installation.

In my previous patent, U.S. Pat. No. 10,407,927, I disclosed a wave pool which used a submerged plow, driven through the pool, to create surfable waves more efficiently and more simply than other systems. The new system below is even more efficient and more simply constructed.

Lahlou, Pneumatic Device For Producing Waves In A Liquid Medium And Process For Its Application, FR Patent 2,564,534 (Nov. 22, 1985) discloses wave pool with a plurality of undivided chambers in a body of water, each disposed partially below the surface, all aligned along the length of the body of water, with each chamber assembly comprising a first portion disposed partially below the surface and extending toward the bottom of the water volume, with an aperture proximate the bottom of the first portion, a vent and an air supply in fluid communication with the first portion. As Lahlou explains, generation of waves in his system depends on rapidly forcing water downward within the chamber (by injecting air into the chamber using a blower), and hence out of the low aperture and into the pool, to initiate formation of a wave, followed by stopping the injection of air, followed by venting the chamber. Lahlou's system does this for a number of chambers, arranged along a side of the pool opposite the beach (the shallow side of the pool enclosure and volume of water), operated in sequence, to create waves which propagate orthogonally (perpendicularly) to the line defined by the chambers and apertures (away from the apertures, toward the shallow side of his pool), or orthogonally to the edge of the pool along which the chambers and apertures are aligned. This is depicted in FIG. 1A, which is reproduced from Lahlou, showing the line of chambers operated to create a wave which propagates away from the line of apertures, and toward a shallow side of the pool which is opposite the side on which the chambers are disposed. If it is possible to make this wave break, the break must arise at the portion of the wave first approaching the shallow side of the pool and propagate along the wave crest without advancing in the direction of the wave front.

SUMMARY

The devices and methods described below provide for generating surfable waves in a pool. Waves are generated by (1) removing support, at a progression of areas at the bottom of the pool, for the water in the pool and/or (2) causing rapid downflow at a progression of areas at the bottom of the pool, for the water in the pool or (3) dropping a portion of the pool floor at a progression of areas at the bottom of the pool, for the water in the pool. As water in the pools drops first in one area, then in a second area, then in a third area adjacent to the second area, and so on for any number of subsequent areas, a travelling wave can be generated. Depending on the sequence and rapidity of bottom support removal, surfable waves of different preferred waveforms may be created.

Removal of bottom support results in rapid downflow of water within the pool, locally at the area in which support is removed. One system and method for doing so comprises a series of chambers arranged along the length of the pool and positioned below the water volume of the pool. Each chamber includes a first portion in direct or indirect fluid communication with the pool. The chamber also preferably includes second portion in fluid communication with the first portion and the pool. The second portion is open at the top, providing a fluid pathway from the water volume of the pool, downwardly through the second portion. A baffle separates the first portion from the second portion, and extends toward the bottom of the chamber, leaving a fluid pathway between the second portion and the first portion. The first portion is vented to atmosphere, through a valved vent communicating from a high point in the first portion to atmosphere. The system also includes an air supply (compressor or blower), in fluid communication with the first portion, operable to force air into the first portion.

In an embodiment that includes chambers with a single portion, each chamber may be vented to allow water to flow downward and under the baffle into the single portion (when the single portion is initially filled with air), by opening the vent to allow air to escape from the first portion of the chamber. With the vent open, and the single portion initially filled (entirely or partly) with air, the water pressure at lower levels of the water volume of the pool, which exceeds ambient air pressure, causes water to rush downward into the single portion, beneath the baffle and into the single portion while forcing air through the vent. To stop the downflow of water proximate the opening of the single portion of the chamber, the vent is closed so that little or no air can escape through the vent. This cycle may be repeated several times to cause downflow adequate to create waves (in coordination with similar sequential operation of other chambers) before the water in the single portion must be emptied of water and re-filled with air so that it is ready for operation in creating more waves.

In the embodiment which includes a first portions and second portions, each chamber may be vented to allow water to flow downward through the second portion and under the baffle into the first portion (when the first portion is initially filled with air), by opening the vent to allow air to escape from the first portion of the chamber. With the vent open, and the first portion initially filled (entirely or partly) with air, the water pressure at lower levels of the water volume of the pool, which exceeds ambient air pressure, causes water to rush downward into the second portion, beneath the baffle and into the first portion while forcing air through the vent. To stop the downflow of water proximate the opening of the second portion of the chamber, the vent is closed so that little or no air can escape through the vent. This cycle may be repeated several times to cause downflow adequate to create waves (in coordination with similar synchronize operation of other chambers) before the water in the first portion must be emptied of water and re-filled with air so that it is ready for operation in creating more waves.

The air supply may be operated as necessary to recharge the first portion, and is operable to force air into the first portion at pressure exceeding the water pressure at the lower levels of the water volume of the pool and the water in the first portion and thus force water in the first portion back through the opening under the baffle, into the second portion and back into the main water volume of the pool. The method may performed without injecting air into the chamber assemblies to cause a forceful outflow of water from apertures of the chambers (and a resultant upflow of water adjacent the apertures), using the air supply to empty first portions of the chamber assemblies of water preparatory to opening vents in sequence to generate waves in the pool. Thus, after injecting air into the chambers, waves may be generated without the use of moving parts (motors, plows, rams, etc.), with the sole exception of the vents.

The valved vent and air supply may be operated repeatedly to draw water in the water volume of the pool downward into the second portion and then into the first portion under the baffle, and recharge the air in the first portion, forcing water from the first portion. In coordination or synchronization with other chambers disposed along the length of the pool, the repeated venting and recharging of the first portion of chambers, one at a time and with one chamber being vented and flooded, and then an adjacent second chamber being vented and flooded, and then a third adjacent chamber, adjacent to the second chamber, being flooded and vented, and so on to the nth chamber will cause a wave to propagate along the length of the pool. The waves may propagate from either end of the pool to the other merely by reversing the sequence of operation of the venting.

The chambers may be located beneath the pool, either directly under the pool or beside the pool yet in fluid communication with the pool.

DETAILED DESCRIPTION OF THE INVENTIONS

Figure 1B:
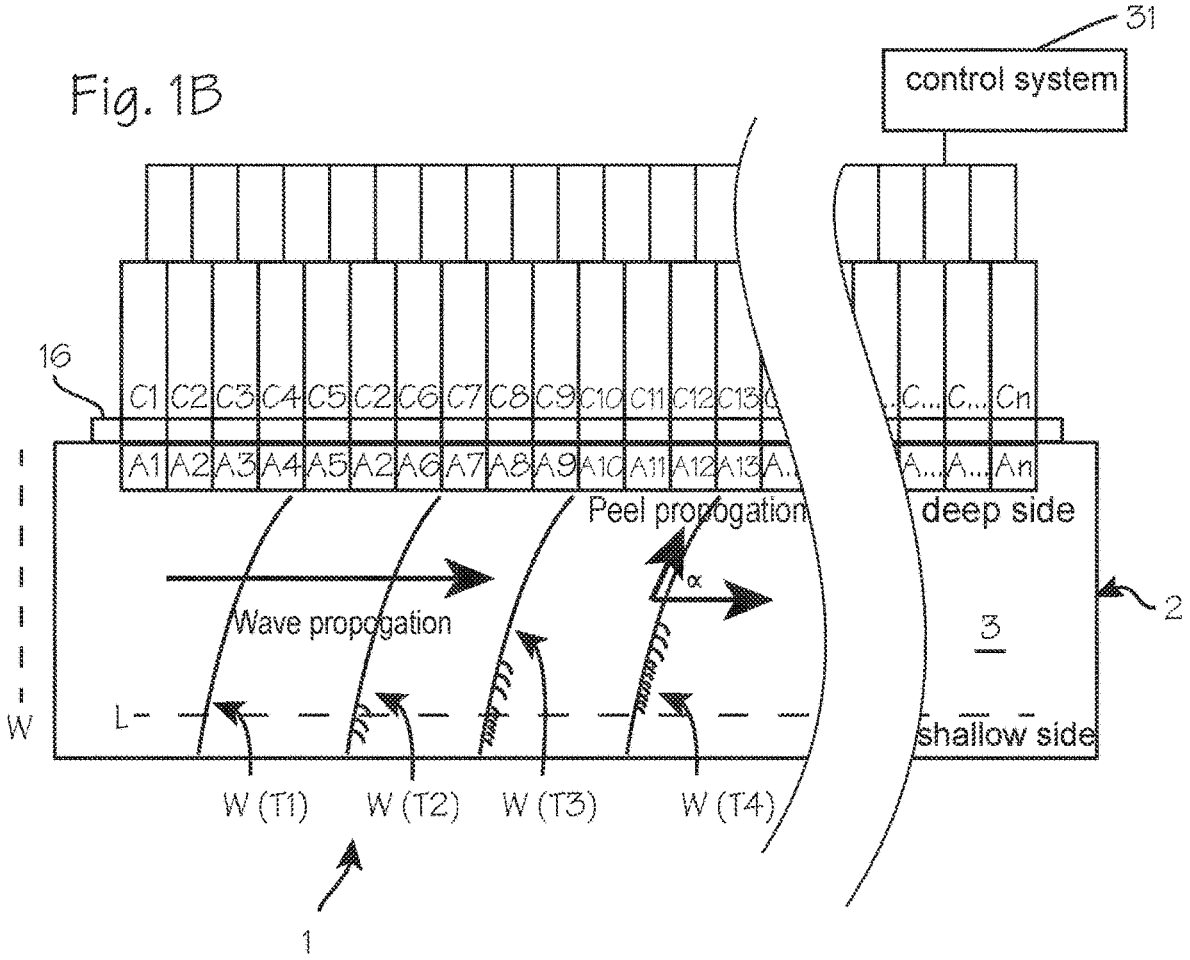
FIG. 1B is an overhead view of a wave pool comprising a series of chambers operable to create downflow of water in the pool in a sequence along the length of the pool to create a surfable wave.

FIG. 1B is an overhead view of a wave pool comprising a series of chambers operable to create downflow of water in the pool in a sequence along the length of the pool to create a surfable wave. The wave pool 1 includes an enclosure 2 which encloses the water volume 3 of the pool and a series of chamber assemblies C1, C2, C3, etc., in fluid communication with the water volume. The pool has a length L and a width W, and a wall 16 extending along the length of the pool, and an edge or beach extending along the length of the pool opposite the wall. Each chamber has an opening or aperture A1, A2, A3, etc., which serve as downflow pathways, which, when conducive to downflow, allows rapid flow of pool water downwardly in the area of the opening. The wall 16 is preferably disposed proximate the openings or apertures A1, A2, A3, etc., with the line of apertures between the wall and the edge or beach. FIGS. 5 through 6, and FIGS. 7 and 12, and FIGS. 13 and 14 illustrate several chamber systems for doing so.

Figure 2:
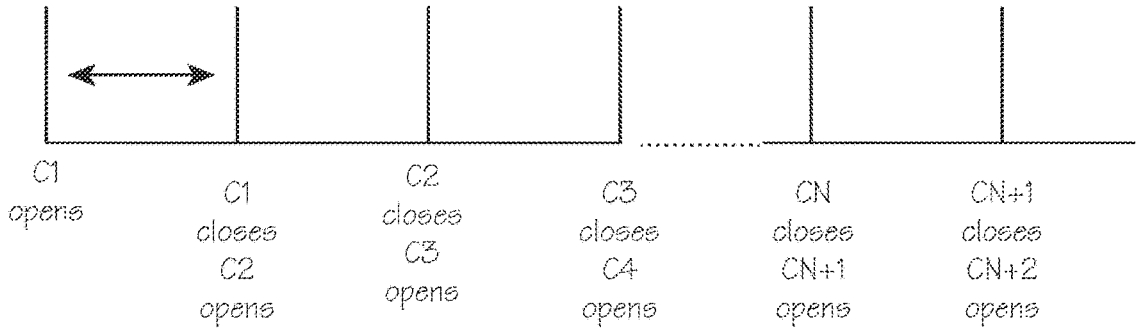
FIGS. 2, 3 and 4 are timing charts, illustrating different options for the sequencing of operating the chambers to create downflow of water proximate each chamber.

The chambers may be operated sequentially, with a first chamber C1 operating to allow downflow in opening A1, followed by operating the second chamber C2 to allow downflow in opening A2, followed by operating the third chamber C3 to allow downflow in opening A3, etc. The downflow in opening A1 is halted near the time when downflow in opening A2 is initiated, and the downflow in opening A2 is halted near the time when downflow in opening A3 is initiated, and so on, such that downflow in one chamber is halted as downflow in an adjacent subsequent chamber is initiated. Generally, downflow in a chamber is initiated before downflow in an adjacent subsequent chamber is initiated, such that there is a brief delay in initiating downflow in an adjacent chamber after initiation of downflow in a preceding chamber. As shown in the timing chart of FIG. 2, downflow in one chamber may be halted simultaneously with initiation of downflow in an adjacent subsequent chamber, such that there is no overlap of downflows, and no interval between downflow, between each chamber and the next adjacent chamber. As shown in the timing chart of FIG. 3, downflow in one chamber may be halted just before downflow in an adjacent subsequent chamber is initiated, such that there is a brief interval between downflows of a first chamber and the next adjacent chamber. As shown in the timing chart of FIG. 4, downflow in one chamber may be halted just after downflow in an adjacent subsequent chamber is initiated, such that there is a brief overlap of downflows between each chamber and the next adjacent chamber.

In practice, because opening and closing of the vent is not instantaneous, initiation of closing and opening of the vent may be controlling, in which case:

Again referring to FIG. 2, closing the vent controlling downflow in opening A1 may be initiated simultaneously with initiating opening the vent controlling the opening in opening A2 (simultaneous), and closing the vent controlling downflow in opening A2 may be initiated simultaneously with initiating opening the vent controlling the opening in opening A3 (simultaneous), and so on, such that closing of the vent of one chamber is initiated as opening of the vent in an adjacent subsequent chamber is initiated. Thus, there is no overlap or interval between initiating of the closing of one vent and initiation of opening the next adjacent vent.

Figure 3:
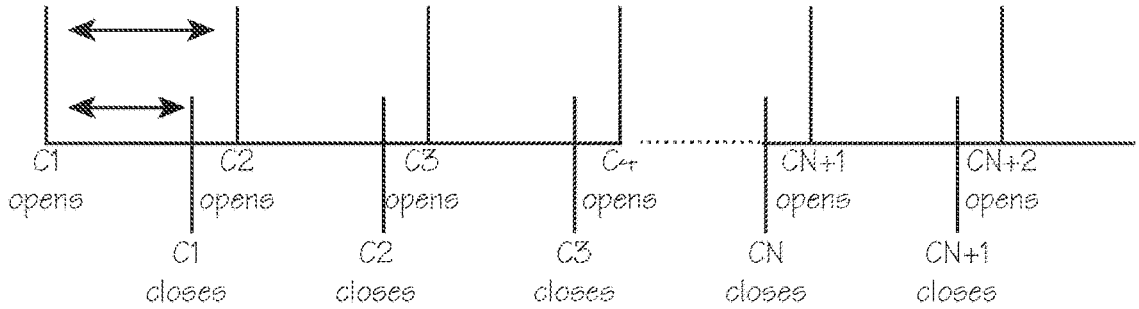
Figure 4:
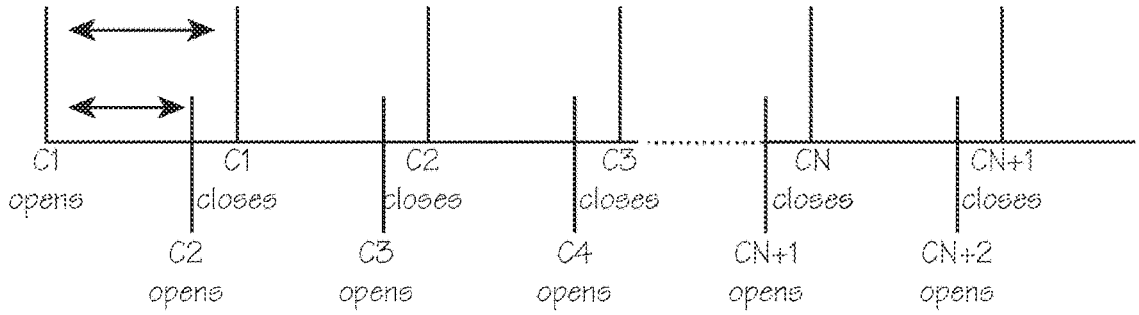

Likewise, referring to the timing chart of FIG. 3, closing the vent controlling downflow in one chamber may be initiated just before initiating opening of the vent controlling downflow in an adjacent subsequent chamber, such that there is a brief interval between initiating closing of the vent controlling downflow of a first chamber and initiating opening of the vent controlling downflow in the next adjacent chamber. Likewise, referring to the timing chart of FIG. 4, closing the vent controlling downflow in one chamber may be initiated just after initiating opening of the vent controlling downflow in an adjacent subsequent chamber is initiated, such that there is a brief overlap of the open status of the vent between initiating closing of the vent controlling downflow of a first chamber and initiating opening of the vent controlling downflow in the next adjacent chamber.

Also, the vents may all be operated simultaneously to open and close the vents, to create a wave that propagates from the wall 16 to the shallow edge of the pool, moving up the sloped bottom shown in the later Figures.

As shown in FIG. 1B, the chambers may be disposed partially under the water volume of the pool, either at the bottom of the pool enclosure or low in the water volume of the pool, with a portion of the chamber including the aperture disposed under the water volume of the pool. The numerous chambers may also be disposed entirely under the pool enclosure. The pool enclosure may comprise earthen works, and comprise an earthen works pit built up above grade of the surrounding area and/or a pit dug into the ground below grade, or a manufactured tank or tub.

Chamber dimensions may vary greatly, depending on the size of the pool and the desired length of the created waves. Chambers of about 40 feet×8 feet×8 feet or so (or 12 m×2.4 m×2.4 m, about the size of a standard shipping container) will provide good surfable waves in a large pool.

Figure 6:
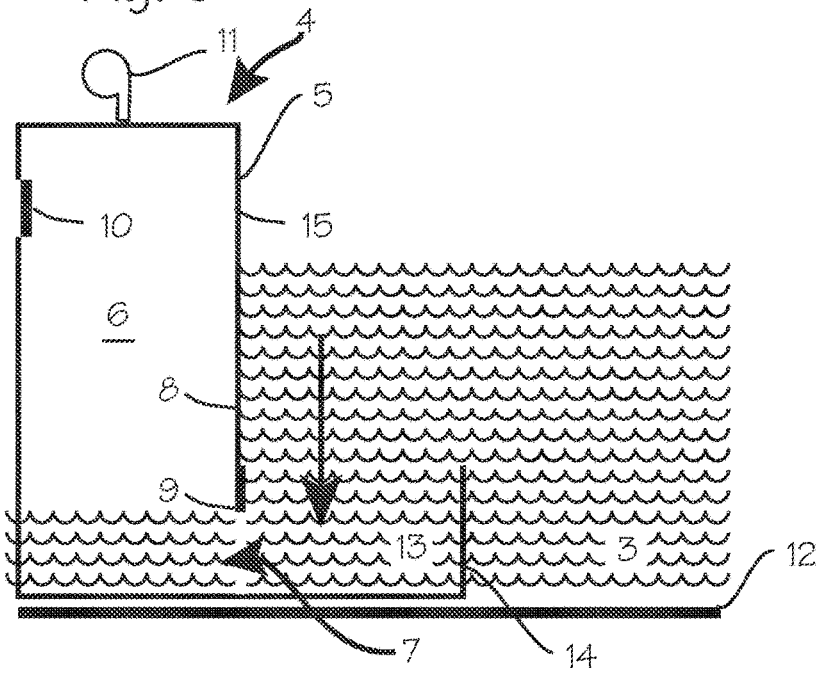
FIGS. 5 and 6 illustrate chambers operable to create localized downflow in the water volume of the pool.
Figure 5:
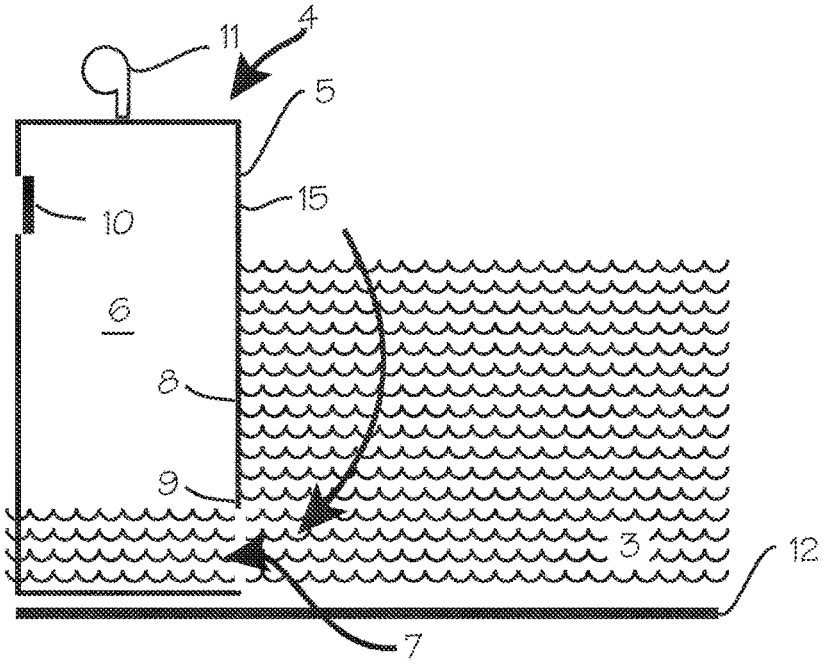

FIGS. 5 and 6 illustrate simple embodiments of chambers operable to create localized downflow in the water volume of the pool.

In FIG. 5, the chamber assembly 4 (any one of chamber assemblies C1, C2, C3, etc.) comprises the chamber 5 with a single portion 6, with an aperture 7 toward the bottom of the single-portion chamber 6 and toward the bottom of the pool (or, at least, at depth within the pool). High air pressure within the single portion 6, in an initial condition, prevents water from rising in the chamber above the level of the top of the aperture so that the wall acts as a baffle 8 with a bottom edge 9 to restrain flow of water into the single portion 6. The surface 6S of the water level in each first portion is below the surface of the water volume.

The chamber assembly 4 also includes a vent 10 communicating from a high point in the single-portion chamber 6 to ambient atmosphere or some other volume at less pressure than the water pressure of the water on the lower areas of the single portion. The vent may be a fast-acting large valve operable to open rapidly and allow rapid escape of air from the single portion, such as a butterfly valve. The vent may be a shut-off valve (operable to open and close, but not suitable for fine-tuned throttling) or a throttle valve, and throttling or provision of larger flow rates for some flooding vis-à-vis other flooding can be accomplished by providing several vent valves in each chamber, and opening a variable number of the valves to provide larger or smaller evacuation rates of air. For example, later floods, when the chamber is partially flooded after earlier floods, may be quickened by opening additional vents.

An air supply 11 is in fluid communication with the single portion of the chamber. The air supply may be an air compressor or blower, operable to force air into the chamber at a pressure higher than the water pressure in the single portion. As shown, the chamber bottom may be disposed at depth within the water volume of the pool, and the chamber ceiling may be disposed above the surface of the water volume of the pool. The chamber assembly 4, including the single portion 6, baffle 8, vent 10 and air supply 11 may also be disposed partially or entirely under the water volume of the pool, under the floor 12 of the pool.

In FIG. 6, the chamber includes a second portion 13 established beside the first portion 6, with the second portion vertically oriented (with the long axis vertical) and extending from the bottom of the chamber assembly upwardly toward the water line of the pool, but terminating well below the surface of the water volume of the pool. The second chamber provides a restrained pathway for downward flow of water, with wall 14 which defines the second chamber which also acts as a baffle, to direct flow downwardly before it enters the first portion, such that downward flow from above the second portion is more constrained to the region directly above the second portion.

In both FIGS. 5 and 6, a sidewall 15 of the chamber, along with sidewalls of the remaining chambers, may form the wall 16 along the length of the pool (shown in FIG. 1) which is useful for reflecting water from the deep side of the pool to assist in creating surfable waves. The vent valve and air supply may or may not be enclosed in an additional or second chamber, as they are in embodiments in which they are disposed beneath the water line.

Both embodiments may be operated as described below in relation to FIGS. 7 through 12, likewise arranged in line with other chambers and operated in coordination with the other chambers to cause a series of downflows, each adjacent to a previous downflow (after the first such downflow), to create a surfable wave.

FIGS. 7 through 12 illustrate a chamber assembly 4 operable to create localized downflow areas in the water volume of the pool and also illustrate various stages in the operation of the chambers to cause localized downflow of water in the water volume of the pool. These figures show the pool 1 and pool enclosure 2 and water volume 3 of the pool, the wall 16 running along the length of the pool, and the pool floor 12. The enclosure in this example is formed of earthen works, a natural body of water, an inground pool enclosure, or an above ground pool enclosure. One of the several chamber assemblies 4 is shown, disposed below the water volume of the pool. As shown in these figures, the chamber assembly comprises the chamber, 5, which is divided into a first portion 17 and a second portion 18. A baffle 19 with a bottom edge 20 is disposed in the chamber between the first portion 6 and the second portion 13, and extends from the top or ceiling 21 of the chamber and toward the bottom or floor 22, leaving a fluid pathway 23 between the first portion and the second portion, under the bottom edge of the baffle. The chamber assembly also includes a vent 10 communicating from a high point in the first portion to ambient atmosphere or some other volume at less pressure than the water pressure of the water on the lower areas of the first portion and second portion. The vent may be a fast-acting large valve operable to open rapidly and allow rapid escape of air from the first portion, such as a butterfly valve. An air supply 11 is in fluid communication with the first portion the chamber. The air supply may be an air compressor or blower, operable to force air into the first portion at a pressure higher than the water pressure in the first portion. The chamber assembly, including the first portion, second portion, baffle, vent and air supply may be disposed entirely under the water volume of the pool, under the floor of the pool. As illustrated, the vent valve 10 and air supply 11 may be disposed in a watertight second chamber 24 disposed under the water volume of the pool, with an exhaust/supply chimney 25 (if needed) extending from the second chamber to ambient atmosphere or some other volume at less pressure than the water pressure of the water on the lower areas of the first portion and second portion, but the vent valve and air supply may be disposed elsewhere, even outside the pool enclosure or the chamber assembly, and need only be in fluid communication with the first portion. The pool floor 12 and ceiling 21 may be a single structure (the pool floor may serve as the top of the chamber assembly), or may be separate structures.

Figure 7:
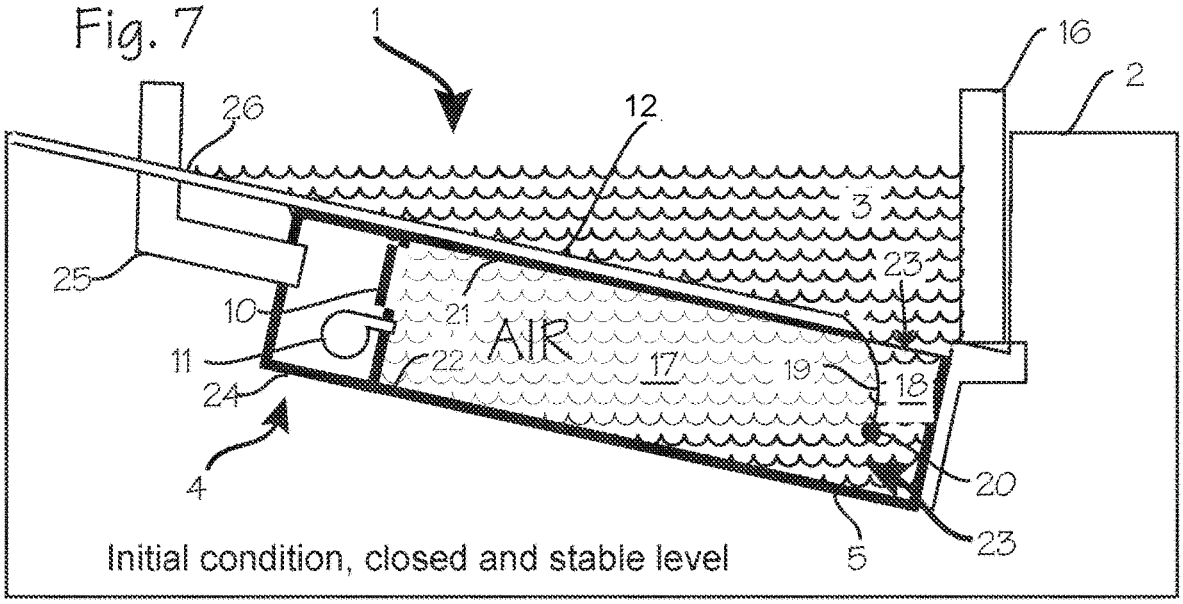
FIGS. 7, 8, 9, 10, 11 and 12 illustrate a chamber operable to create localized downflow areas in the water volume of the pool and also illustrate various stages in the operation of the chambers to cause localized downflow of water in the water volume of the pool.

FIG. 7 illustrates an initial condition of a chamber, in which the first portion is fully charged with air. Water occupies the pool enclosure 2 and the second portion, and also partially occupies the first portion to the level of the bottom edge of the baffle. The surface 17S of the water level in each first portion is below the surface of the water volume in the initial condition.

This condition is achieved by pressurizing the first portion to a pressure at least matching the water pressure at the bottom edge of the baffle. (Any higher air pressure will result in air escaping under the baffle.)

Figure 8:
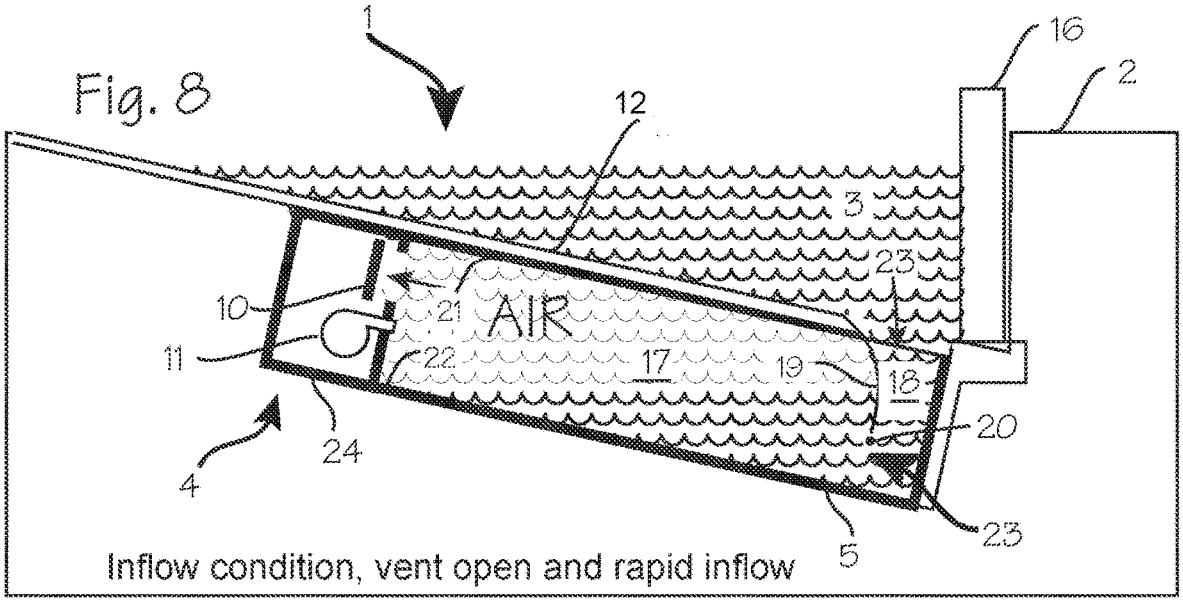

FIG. 8 illustrates a second condition of the chamber of FIG. 7, in which the first portion has been vented. The vent has been opened, and this reduces the air pressure in the first portion to the ambient air pressure, or nearly so, which is the same pressure as the air pressure on the top of the pool, but lower than the water pressure at lower levels of the pool proximate the opening A1 and the slightly higher water pressure in the first portion and in the second portion. This allows water to flow downwardly from the water volume of the pool, downwardly through the second portion, under the baffle, and into the first portion. Water now occupies the pool enclosure and the second portion, and now occupies a larger part of the first portion to the level above the bottom edge of the baffle. Water will continue flowing downwardly through the second portion, and the first portion will continue to flood, so long as the vent is open.

Figure 9:
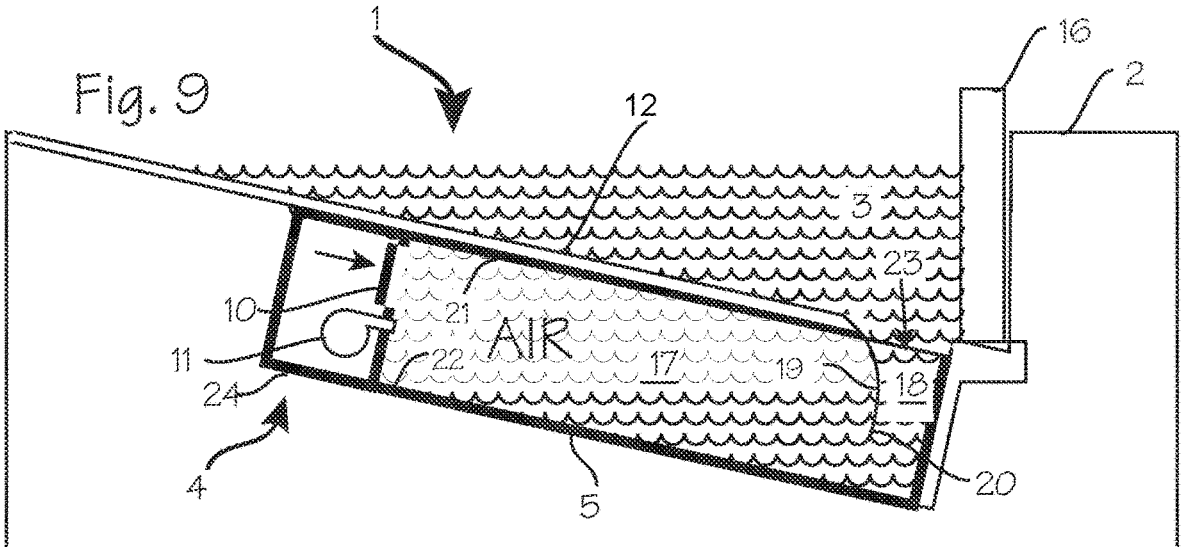
Figure 10:
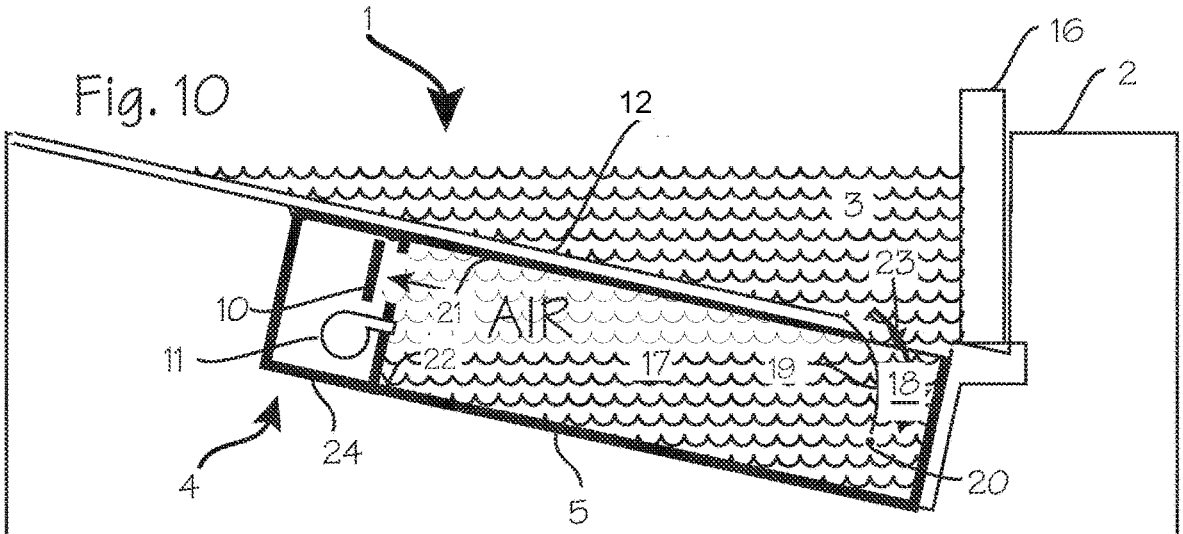
Figure 11:
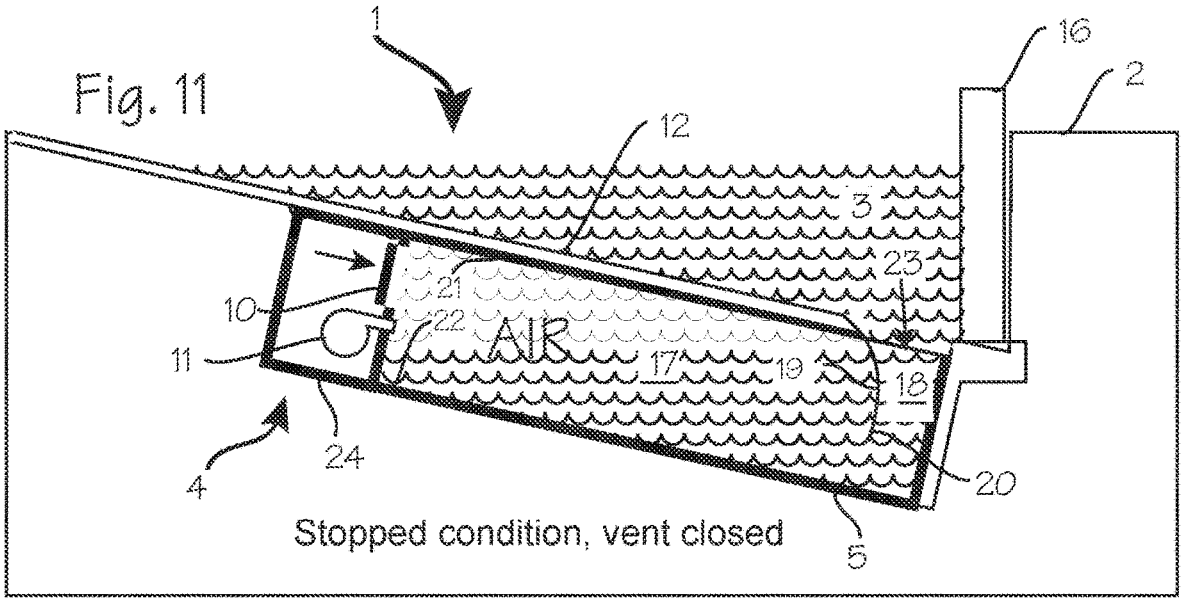

FIG. 9 illustrates a third condition of the chamber of FIG. 7, in which the first portion vent 10 has been closed after it has been momentarily opened as described in relation to FIG. 8. Because air cannot escape from the first portion, the water level can rise only to the level at which the air pressure in the first portion rises to match the water pressure at the now higher water level in the first portion. As shown in FIGS. 10 and 11, the cycle of venting to induce another downflow of water at the aperture A1, and closing the vent to stop the downflow, may be repeated until the air volume in the first portion becomes too small to induce a downflow strong enough to create a wave in conjunction with coordinated operation of adjacent chamber assemblies (or reaches the vent).

Figure 12:
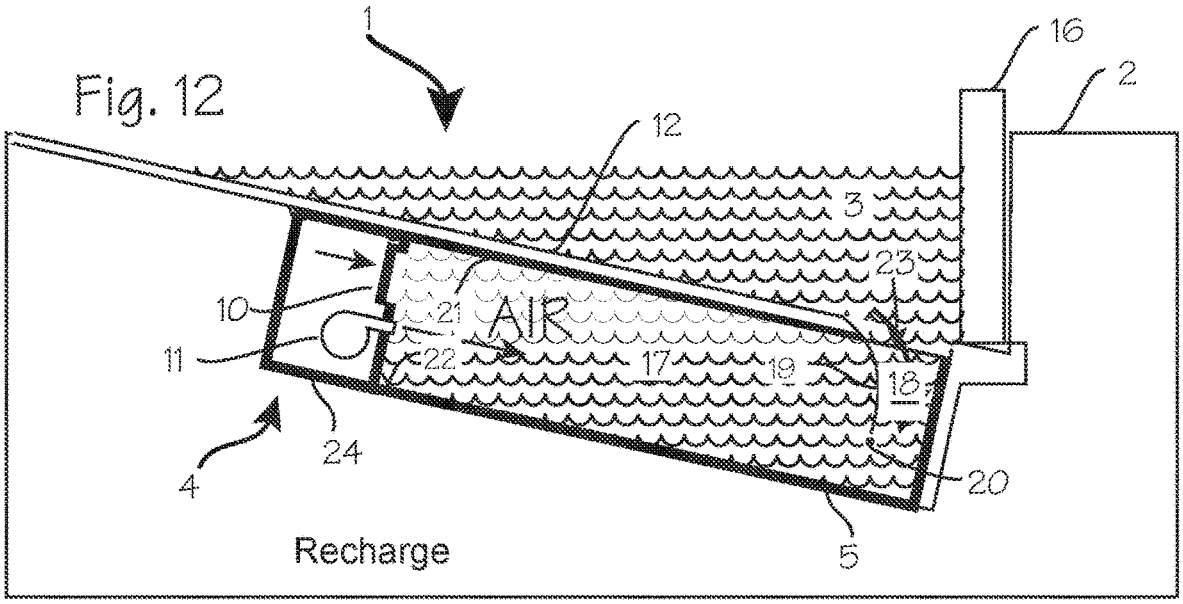

FIG. 12 illustrates the recharging of the first portion. To recharge the first portion, the air supply 11 may be operated to force air into the first portion, at a pressure higher than the water pressure in the first portion. The air supply may be operated intermittently, for example when the first portion is full of water and no longer able to accommodate another in-rush of water, or it may be operated between each created wave, or it may be operated continuously. The air supply may comprise an air compressor operable to inject air at high pressure and high volume, to quickly recharge the chamber. Air pressure supplied at 125 psi (861845 Pa or 8.5 atm) can rapidly recharge the first portion in a chamber. Higher or lower pressures may be used, depending on how quickly it is desired to recharge. The air supply may comprise a blower. Both types of commercially available air supply means are available in configurations that provide a wide range of output pressure and output volume, and may be used to recharge the first portion.

A single air supply may supply two or more of the chamber assemblies, through a supply manifold leading from the single air supply with branches feeding each first portion, and the supply of air to the first portions can be controlled with supply valves in each branch.

The vent valve and air supply may be disposed within the watertight second chamber 24, and may comprise an air compressor or blower disposed within the second chamber, or may comprise a manifold branch of a manifold configured to supply air from a common air compressor or blower.

Clarifying definitions will assist in understanding the invention. "Water line" or "shoreline" refer, naturally, to the water line of the body of water, which is the level where the body of water and the surrounding land meet, at the ambient atmosphere/water interface, when the pool is quiescent or calm. "Sequentially adjacent" means that each opening, or chamber, or other components is arranged one after another, with a first chamber or aperture of a chamber disposed proximate a second chamber, a third chamber proximate the second chamber with the second chamber between the first and third chamber, a fourth chamber proximate the third chamber with the third chamber between the fourth and second chamber, and so on, until the nth+1 chamber is adjacent with nth chamber with the nth chamber between the nth+1 chamber and the nth−1 chamber. A chamber is any enclosed or partially enclosed volume defined by an enclosure, such as a water tank, shipping container or the like, an accumulator, or a void or cave in earthen works.

As shown in the cross section of FIG. 7, the pool floor is sloped downwardly toward the apertures of the chamber and toward the wall 16, and the chamber assemblies are also inclined with the second portion disposed lower than the first portion. As shown, the chambers are arranged along the length of the pool and are inclined, sloping downwardly toward the wall 16, with the second portion partially below the first portion and the first portion partially above the second portion. While this arrangement is preferred, suitable waves may be generated with a flat floor, or a chamber with the first and second portions level, or both. As depicted in FIG. 7, the disposition of the second portion partially below the first portion and the first portion partially above the second portion can result in the bottom of the second portion (the lowest extent of the inside of the second portion) being lower than the bottom of the first portion (the lowest extent of the inside of the first portion), and the top of the first portion (the highest extent of the inside of the first portion) being higher than the top of the second portion (the highest extent of the inside of the second portion), though some intermediate level of both portions maybe at the same level. Also, the first portion, as depicted, may have a top that is at least partially disposed, and preferably entirely disposed, below the surface of the water volume of the pool and under the surface of the water volume of the pool (that is, at least some, and preferably all, of the first portion is covered by water). While this arrangement is preferred, suitable waves may be generated with a flat floor, or a chamber with the first and second portions level, or both, as shown in FIGS. 13 and 14.

As shown in FIGS. 7 through 13, the overall footprint of the system is greatly reduced by placing the first portion and perhaps the pump and vent and its chamber, outboard of the second portion. That is, the second portion is disposed adjacent to a long wall of the pool, as shown in all the figures excepting FIG. 1 and FIG. 14, disposed between (relative to the horizontal) the first portion and the same long wall of the pool nearest. In other words, the first portion can be disposed outboard of the second portion, with the long edge of the pool on one side of the second portion and the first portion on the opposite side of the second portion. The first portion may extend to the opposite side of the pool from the second portion, and the second chamber of each chamber assembly may be disposed on the opposite side of the pool from the second portion, and may be entirely submerged (as in FIG. 7), partially submerged, or entirely above the surface of the water volume. Also as shown in FIG. 7, the first portion 6 and second portion 13 of the chamber assembly are disposed entirely between the wall 16 extending along the length of the pool, and the edge or beach 26 extending along the length of the pool opposite the wall long edges of the pool.

Figure 13:
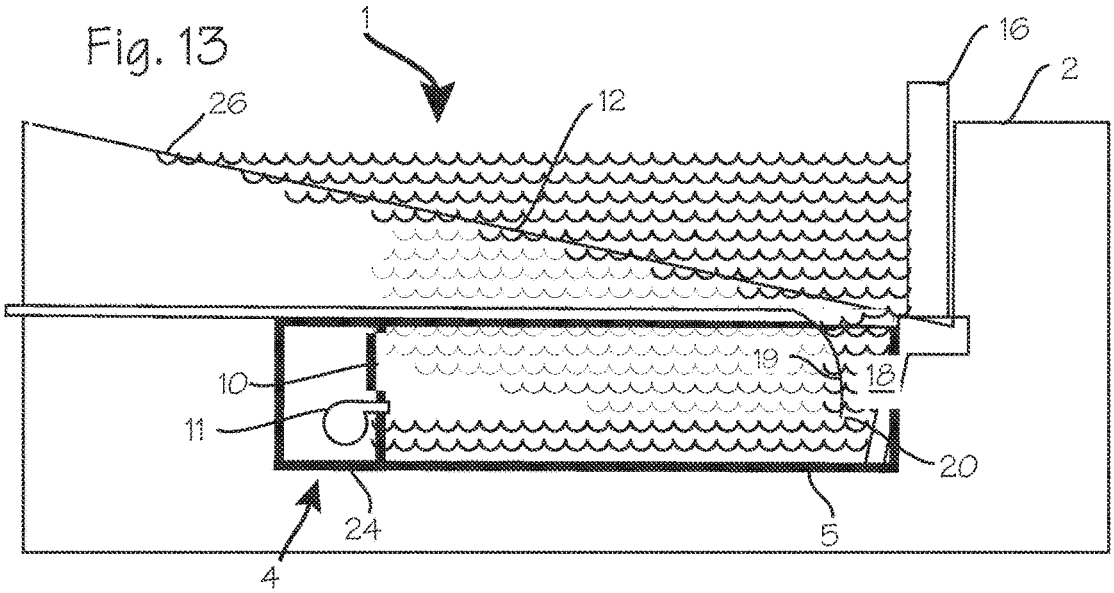
FIGS. 13 and 14 illustrate alternative arrangements of the pool and chambers of FIGS. 7 through 12.
Figure 14:
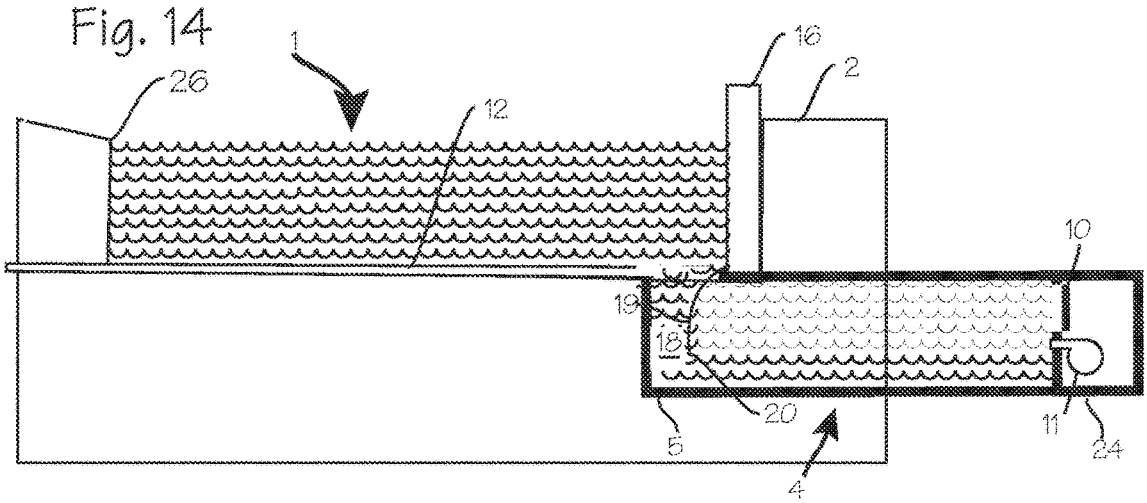

FIGS. 13 and 14 illustrate alternative arrangements of the pool and chambers of FIGS. 7 through 12. FIG. 13 illustrates an embodiment in which the floor is sloped downwardly toward the apertures and the wall, and, conversely, slopes upwardly toward a beach area above the water level of the pool. In FIG. 13 the chamber of FIGS. 9, et seq. is oriented horizontally, and the pool bottom is inclined, with second portion (the downflow path) disposed under the deep side of the pool. FIG. 14 illustrates an embodiment in which the pool floor is flat, and also illustrates placement of the chamber in which the chamber second portion is disposed under the water volume of the pool and the first portion, while below the water volume, is not directly beneath water volume (as in FIG. 1). The chamber may also be inclined, with the second portion above the first portion, as shown in FIGS. 7 through 12. In FIG. 14, the chamber of FIGS. 9, et seq. is oriented horizontally.

Figure 15:
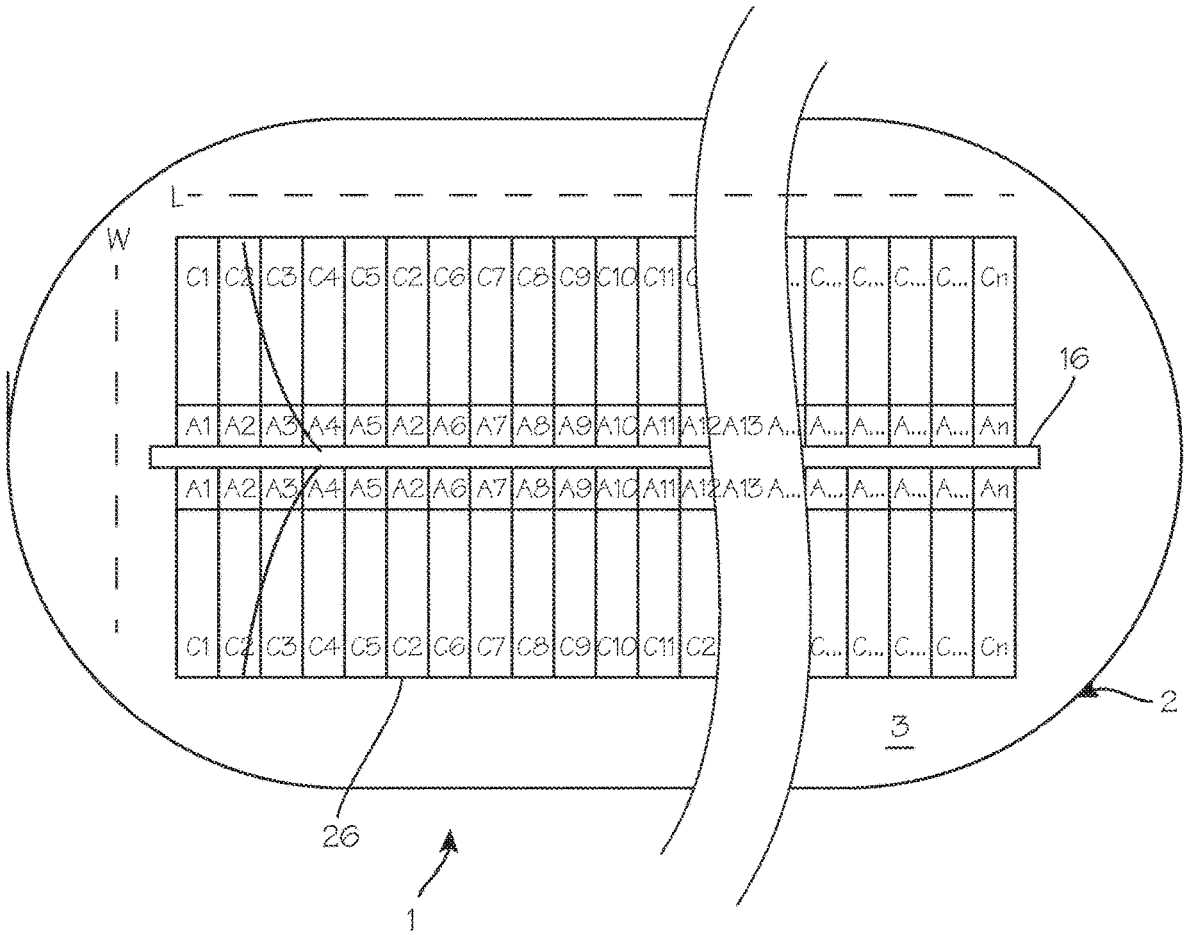
FIG. 15 illustrates a configuration of a wave pool with two sets of chambers in a single body of water.

FIG. 15 illustrates a configuration of a wave pool with two sets of chambers in a single body of water. Each group of chambers is disposed under the water volume of the pool, with the downflow apertures positioned near a central wall 16 and each of the chamber first portions extending laterally away from the wall, across the width of the pool, toward outer edges of the pool. As in FIGS. 7 through 12, the pool may have a sloped bottom, sloping downward from the sides of the pool toward the center of the pool along the line of the center wall. Each group of chambers can be operated as described above.

Figure 1A:
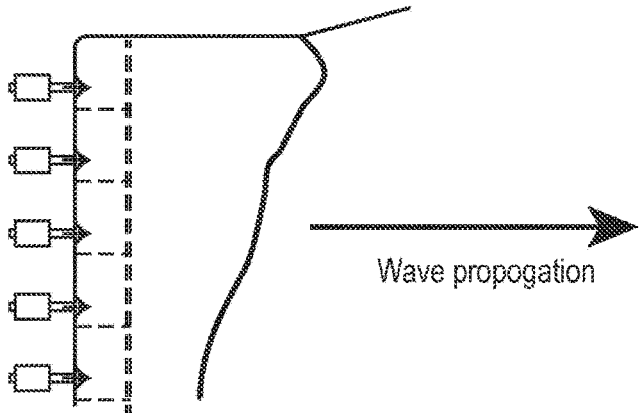
Fig. 1A (Prior Art)
FIG. 1A is an overhead view of a prior art wave pool.

The group of chambers in FIG. 1 can be controlled with a control system 31, which is preferably a computerized control system but may be an analog control system, configured and operable to control the various vent valves and air supplies, in order to open and close vents in the sequences describe above, and optionally also able to control the air supplies to inject air into the chamber first portions to recharge each chamber.

The system can generate a surging wave, a spilling wave, or a plunging wave, or the system can produce a wave which, extending across the stage (going from one end to the other, along the major length L of the pool), includes a surging portion, a spilling portion and a plunging portion. The waves may propagate from either end of the pool to the other merely by reversing the sequence of creation of localized downflow areas, or reversing the sequence of venting the series of chambers. The system can also generate a wave propagating across the width W of the pool.

The method of creating a wave in a body of water, using the system of chambers described above or other systems, can include the steps of creating a sequence of localized downflows along a length of the body of water, by causing a first localized downflow in a first area of the body of water, thereafter causing a second localized downflow in a second area of the body of water adjacent the first area, thereafter creating a third localized downflow in a third area adjacent the second area not adjacent to the first area, and so on. The method can include halting the first localized downflow, and, simultaneously, initiating the second localized downflow, and so on, or halting the first localized downflow PRIOR TO initiating the second localized downflow, and so on or halting the first localized downflow AFTER initiating the second localized downflow, and so on. When implementing the method with the system of chambers disclosed above, the method can include arranging a series of chambers, including a first chamber, second chamber, third chamber and so on, each with a first portion and each with an opening providing for fluid communication between the body of water and the first portion of each, with the openings arranged along a line, with each opening being disposed beneath the surface of the body of water, with each opening being adjacent to a preceding and/or subsequent opening; allowing water in the body of water to flow into the first portion of the first chamber through a first opening of the first chamber (under the baffle) to induce downflow proximate the first aperture or chamber; and thereafter allowing water in the body of water to flow into the first portion of the second chamber through a first aperture of the second chamber, under a baffle, to induce downflow proximate the second chamber; and thereafter allowing water in the body of water to flow into the first portion of subsequent chambers through a first aperture of the subsequent chambers to induce downflow proximate each subsequent aperture or chamber. After allowing water to flow into a chamber, air may be forced into said chamber in order to force water in the chamber back into the body of water. The method may performed, as described above, without injecting air into the chamber assemblies to cause a forceful outflow of water from apertures of the chambers (and a resultant upflow of water adjacent the apertures).

Referring again to FIG. 1B, the system is operable to create waves W, propagating along the length L of the enclosure 2, along a line parallel to the line of chamber assemblies C1, C2, C3, etc. The wave W (T1) at time T1 arises first near the line of chamber assemblies (C1, C2, C3, for example) and then on the opposite side of the enclosure. The same wave W (T2) at time T2 has propagated along a line parallel to the line of chamber assemblies, and, depending on the speed of the sequence of opening vents, may begin to crest, spill and/or plunge near enclosure edge opposite the line of chamber assemblies (the shallow side of the enclosure). The wave may continue travel along the length of the enclosure, illustrated as wave W (T3) at time T3. The wave may peel from the opposite side to the side of the chamber assemblies, such that the break has propagated toward the line of apertures. The propagation of the break along the wave front is referred to as peeling. This would be a right to left peel from the vantage point of a surfer, and the wave would be referred to as a left-hand wave. The system can operated to create a right-hand wave by starting the opening of the vents, and thus downflow into the apertures, from the other end of the pool (opening vents in CN, CN-1, CN-2 and so on). The angle between the direction of propagation of the wave front (parallel to the line of apertures) and the direction of the peel P may be referred to as the peel angle $\alpha$. In this Figure, the peel angle is acute, with the broken portion of the wave front following the leading portion of the wave which is nearer to the line of the apertures. The system may configured and controlled to create waves with a peel angle of 30° to 75°, more preferably to create waves with a peel angle of 45° to 65°, by varying the speed of venting of the chamber assemblies, the dimensions of the enclosure and the size of the chambers relative to the dimensions of the enclosure.

The peeling break created by the system travels along a line toward to the line of apertures consistent with the propagation the wave front parallel to, or along, the line of the apertures of the chambers. The system creates waves which propagate parallel to the line defined by the apertures, or parallel to the edge of the enclosure along which the apertures are aligned. The chambers may, as shown in FIG. 1B, be aligned on the same side of the enclosure as the apertures, disposed outside the boundaries of the enclosure, or under the enclosure as depicted in FIG. 15 and other figures.

Thus, as described above, the system for generating waves in a body of water which comprises a water volume enclosed by an enclosure and a plurality of chamber assemblies disposed at least partially below the surface of the water volume, aligned along a length of the body of water. Each of the chamber assemblies comprises (1) a first chamber having a first portion disposed at least partially below the surface of the water volume and extending toward the bottom/floor of the water volume, with a bottom of the first portion disposed below the surface of the water volume and a top of the first portion above the bottom of the first portion (optionally the top of the first portion is also below the surface of the water volume), (2) an aperture proximate the bottom of the first portion, establishing a flow path from the water volume into the first portion, (3) a vent proximate the top of the first portion, operable to open to allow air to escape from the first portion, thereby allowing water to flow through the aperture, from the enclosure and into the first portion, (4) an air supply in fluid communication with the first portion, operable to inject air into the first portion to force water in the first portion out of the first portion and through the aperture and into the enclosure (optionally used only to place the system in an initial condition, or, in a less preferred mode, to force water out of the chamber first portion to generate a wave); and (5) a control system operable to control the vent of each of the chamber assemblies to open and close the vent of each of the chamber assemblies (and, optionally, to control the air supply to inject air into the first portions).

The control system is configured to (1) control the vent of each chamber from an initial condition in which the first portion of each of the chamber assemblies is filled with air such that the surface of the water level in each first portion is below the surface of the water volume, to create a wave by first opening the vent of each chamber assembly in sequence.

To this point, it is not necessary to use the control system to operate the air supplies to fill the first portions of the chambers to establish the initial condition of the system. The air supplies may be operated by a user, and the system may then operate the vents in sequence to generate one or more waves. If the first portions are large enough, several waves may be created by the system without need to inject more air into the first portions to make room for another downflow of water through the aperture and into the first portion. After a first wave is created, the control system may be operated to initiate creation of a second wave without refilling the first portions with air, and then initiate creation of a third wave without refilling the first portions with air, and so on, repeating the operation to create new waves until the first portions are filled with water to the point that opening the vents will not result in further inflow of water sufficient to generate a desired wave (for example, a surfable wave). Also, it is not necessary to inject air into the first portions to the point where the surface of the water level in each first portion is down to the edge of the baffle: The surface of the water level in each first portion need only be low enough such that the remaining air volume is sufficient to accommodate an inflow of water with sufficient rapidity to generate a wave of desired characteristic (surging, spilling, plunging or mere rippling) in the water volume enclosure.

In addition to controlling the vents in according with mode (1) in paragraph above, the control system may be configured to (2) control the vent of each chamber to create a wave in the enclosure, starting from the initial condition, without injecting air to initiate formation of a wave prior to opening the vent. and/or may also be further configured to operate the air supply to inject air into the first portion of each chamber assembly to evacuate the first portion, preparatory to operating the vents in sequence to create the wave, to place the system in the initial condition, and/or (4) operate the vents in sequence to create the wave while continuously injecting air into the first portion of at least one of the chamber assemblies, regardless of the open or shut status of the vent in said at least one of the first portions.

In use, air supply is preferably used only to recharge the chamber assemblies, without using the air supply to rapidly force water out of the chamber assemblies to initiate creation of a wave by creating a localized upflow of water proximate the apertures of the chamber assemblies. Thus, a mode of operating the system includes creating a sequence of localized downflows along a length of the body of water, by causing a first localized downflow in a first area of the body of water without causing an immediately preceding or subsequent first localized upflow in the first area, thereafter causing a second localized downflow in a second area of the body of water adjacent the first area without causing an immediately preceding or subsequent second localized upflow in the second area, thereafter creating a third localized downflow in a third area adjacent the second area not adjacent to the first area without causing an immediately preceding subsequent first localized upflow in the third area, and so on. The method includes configuring the system in an initial condition, prior to operation to generate a wave, using the air supply of each chamber assembly to inject air into the first portion of each chamber assembly, such that each first portion is at least partially filled with air and the water level in each first portion is below the surface level of the water volume. With the system in the initial configuration, the system is controlled, preferably through the control system, to operate the vents in a sequence (described above) opening the vent of a first chamber assembly amongst the plurality of chamber assemblies, and closing the vent of the first chamber assembly, and thereafter opening the vent of a second chamber assembly amongst the plurality of chamber assemblies adjacent the first chamber assembly, and close the vent of said second chamber assembly, said second chamber assembly being adjacent to said first chamber assembly, and opening the vent of a third chamber assembly amongst the plurality of chamber assemblies adjacent the second chamber, and close the vent of said third chamber assembly, said third chamber assembly being non-adjacent to said first chamber assembly, and so on for any number of subsequent chamber assemblies, to create a wave with a wave front that travels along the length of the body of water. Timing of closing vents, vis-à-vis opening of subsequent vents, may be more specific, and may include (1) performing the step of opening the vent for the second chamber assembly while contemporaneously closing the vent for the first chamber assembly, and opening the vent for the third chamber assembly while contemporaneously closing the vent for the second chamber assembly, and so on, for any number of subsequent chamber assemblies, or (2) performing the step of opening the vent for the second chamber assembly and thereafter closing the vent for the first chamber assembly, and opening the vent for the third chamber assembly and thereafter closing the vent for the second chamber assembly, and so on, for any number of subsequent chamber assemblies or (3) performing the step of opening the vent for the second chamber assembly after closing the vent for the first chamber assembly, and opening the vent for the third chamber assembly after closing the vent for the second chamber assembly, and so on, for any number of subsequent chamber assemblies or (4) performing the step of opening the vent for the second chamber assembly and thereafter closing the vent for the first chamber assembly, and opening the vent for the third chamber assembly and thereafter closing the vent for the second chamber assembly, and so on, for any number of subsequent chamber assemblies.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

What is claimed is:

1. A system for generating waves in a body of water, said body of water comprising a water volume enclosed by an enclosure including a bottom/floor, said water volume characterized by a surface and a bottom/floor, said system comprising:

a plurality of chamber assemblies disposed at least partially below the surface of the water volume, said plurality of chamber assemblies aligned along a length of the body of water, wherein each of the chamber assemblies comprises:

a first chamber having a first portion disposed at least partially below the surface of the water volume and extending below the bottom/floor of the enclosure, with a bottom of the first portion disposed below the surface of the water volume and a top of the first portion above the bottom of the first portion;

an aperture proximate the bottom of the first portion, establishing a flow path from the water volume into the first portion;

a vent proximate the top of the first portion, said vent is operable to open to allow air to escape from the first portion, thereby allowing water to flow through the aperture, from the enclosure and into the first portion;

an air supply in fluid communication with the first portion, said air supply operable to inject air into the first portion to force water in the first portion out of the first portion and through the aperture and into the enclosure;

a second chamber proximate the first portion of the first chamber;

wherein said second chamber extends below the bottom/floor of the enclosure; and wherein said vent is operable to open to allow air to escape from the first portion and into the second chamber; and wherein the air supply is located within the second chamber; and an exhaust chimney; wherein the exhaust chimney is connected through a wall of the second chamber and extends outwardly therefrom and above said body of water to ambient atmosphere, such that air can pass from the first chamber, into the second chamber, and out into the ambient atmosphere; and a control system operable to control the vent of each of the chamber assemblies to open and close the vent of each of the chamber assemblies;

said control system is configured to control the vent and air supply of each chamber from an initial condition in which the first portion of each of the chamber assemblies is filled with air such that the surface of the water level in each first portion is below the surface of the water volume, to create a wave by first opening the vent of each chamber assembly in sequence.

2. The system of claim 1, wherein the control system is configured to control the vent of each chamber to create a wave in the enclosure, starting from the initial condition, without injecting air to initiate formation of a wave prior to opening the vent.

3. The system of claim 2, wherein the control system is operable to open the vent of a first chamber assembly amongst the plurality of chamber assemblies, close the vent of said first chamber assembly, and open the vent of a second chamber assembly amongst the plurality of chamber assemblies adjacent the first chamber assembly, and close the vent of said second chamber assembly, said second chamber assembly being adjacent to said first chamber assembly, and open the vent of a third chamber assembly amongst the plurality of chamber assemblies adjacent the second chamber assembly, and close the vent of said third chamber assembly, said third chamber assembly being non-adjacent to said first chamber assembly, and so on for any number of subsequent chamber assemblies, wherein the control system is operable to open the vent for the second chamber assembly as it closes the vent for the first chamber assembly, and open the vent for the third chamber assembly as it closes the vent for the second chamber assembly, and so on, for any number of subsequent chamber assemblies.

4. The system of claim 2, wherein the control system is operable to open the vent of a first chamber assembly amongst the plurality of chamber assemblies, close the vent of said first chamber assembly, and open the vent of a second chamber assembly amongst the plurality of chamber assemblies adjacent the first chamber assembly, and close the vent of said second chamber assembly, said second chamber assembly being adjacent to said first chamber assembly, and open the vent of a third chamber assembly amongst the plurality of chamber assemblies adjacent the second chamber assembly, and close the vent of said third chamber assembly, said third chamber assembly being adjacent to said second chamber assembly, and so on for any number of subsequent chamber assemblies, wherein the control system is operable to open the vent for the second chamber assembly before it closes the vent for the first chamber assembly, and open the vent for the third chamber assembly before it closes the vent for the second chamber assembly, and so on, for any number of subsequent chamber assemblies.

5. The system of claim 2, wherein the control system is operable to open the vent of a first chamber assembly amongst the plurality of chamber assemblies, close the vent of said first chamber assembly, and open the vent of a second chamber assembly amongst the plurality of chamber assemblies adjacent the first chamber assembly, and close the vent of said second chamber assembly, said second chamber assembly being adjacent to said first chamber assembly, and open the vent of a third chamber assembly amongst the plurality of chamber assemblies adjacent the second chamber assembly, and close the vent of said third chamber assembly, said third chamber assembly being non-adjacent to said first chamber assembly, and so on for any number of subsequent chamber assemblies, wherein the control system is operable to open the vent for the second chamber assembly after it closes the vent for the first chamber assembly, and open the vent for the third chamber assembly after it closes the vent for the second chamber assembly, and so on, for any number of subsequent chamber assemblies.

6. The system of claim 1, wherein the control system is further configured to operate the air supply to inject air into the first portion of each chamber assembly to evacuate the first portion to place the system in the initial condition, preparatory to operating the vents in sequence to create the wave.

7. The system of claim 6, wherein the top of each first portion is proximate the bottom/floor of the enclosure.

8. The system of claim 1, wherein the control system is further configured to operate the vents in sequence to create the wave while continuously injecting air into the first portion of at least one of the chamber assemblies.

9. The system of claim 1, wherein each chamber assembly further comprises:

a second portion proximate the first portion of said first chamber, in fluid communication with the first portion and the body of water, said second portion being open at the top thereof via said aperture thereby providing a fluid pathway from the water volume of the body of water, downwardly through the second portion;

a baffle separating the first portion from the second portion, and extending from the top of the first portion toward the bottom of the first portion, said baffle terminating above the bottom of the first portion thereby establishing the aperture.

10. The system of claim 9, wherein the enclosure has a first side with a wall extending along the length of the pool and a second side comprising an edge extending along the length of the pool opposite the wall, and the bottom/floor of the enclosure is sloped downwardly from the second side of the enclosure to the first side of the enclosure, and the aperture of each first portion is disposed under a lower region of the sloped bottom; and the first portion and second portion of each of the chamber assembly are disposed entirely between the first side and the second side of the pool.

11. The system of claim 9, wherein:

the chamber assemblies are arranged along the length of the body of water and are inclined, sloping downwardly, with the second portion of a first chamber assembly of the plurality of chamber assemblies partially below the first portion of said first chamber assembly of the plurality of chamber assemblies and the first portion of said first chamber assembly of the plurality of chamber assemblies partially above the second portion of said first chamber assembly of the plurality of chamber assemblies; such that the bottom of the second portion is lower than the bottom of the first portion, and the top of the first portion is higher than the top of the second portion.

12. The system of claim 1, wherein the control system is operable to open the vent of a first chamber assembly amongst the plurality of chamber assemblies, close the vent of said first chamber assembly, and open the vent of a second chamber assembly amongst the plurality of chamber assemblies adjacent the first chamber assembly, and close the vent of said second chamber assembly, said second chamber assembly being adjacent to said first chamber assembly, and open the vent of a third chamber assembly amongst the plurality of chamber assemblies adjacent the second chamber assembly, and close the vent of said third chamber assembly, said third chamber assembly being non-adjacent to said first chamber assembly, and so on for any number of subsequent chamber assemblies, wherein the control system is operable to open the vent for the second chamber assembly as it closes the vent for the first chamber assembly, and open the vent for the third chamber assembly as it closes the vent for the second chamber assembly, and so on, for any number of subsequent chamber assemblies.

13. The system of claim 1, wherein the control system is operable to open the vent of a first chamber assembly amongst the plurality of chamber assemblies, close the vent of said first chamber assembly, and open the vent of a second chamber assembly amongst the plurality of chamber assemblies adjacent the first chamber assembly, and close the vent of said second chamber assembly, said second chamber assembly being adjacent to said first chamber assembly, and open the vent of a third chamber assembly amongst the plurality of chamber assemblies adjacent the second chamber assembly, and close the vent of said third chamber assembly, said third chamber assembly being non-adjacent to said first chamber assembly, and so on for any number of subsequent chamber assemblies, wherein the control system is operable to open the vent for the second chamber assembly before it closes the vent for the first chamber assembly, and open the vent for the third chamber assembly before it closes the vent for the second chamber assembly, and so on, for any number of subsequent chamber assemblies.

14. The system of claim 1, wherein the control system is operable to open the vent of a first chamber assembly amongst the plurality of chamber assemblies, close the vent of said first chamber assembly, and open the vent of a second chamber assembly amongst the plurality of chamber assemblies adjacent the first chamber assembly, and close the vent of said second chamber assembly, said second chamber assembly being adjacent to said first chamber assembly, and open the vent of a third chamber assembly amongst the plurality of chamber assemblies adjacent the second chamber assembly, and close the vent of said third chamber assembly, said third chamber assembly being adjacent to said second chamber assembly, and so on for any number of subsequent chamber assemblies, wherein the control system is operable to open the vent for the second chamber assembly after it closes the vent for the first chamber assembly, and open the vent for the third chamber assembly after it closes the vent for the second chamber assembly, and so on, for any number of subsequent chamber assemblies.

15. The system of claim 1, wherein the second chamber is watertight and is disposed under the water volume.

* * * * *